United States Patent [19]

Klaiber et al.

[11] 4,226,157

[45] Oct. 7, 1980

[54] WAVEFORM SYNTHESIS FOR AN ELECTRONIC MUSICAL INSTRUMENT

[75] Inventors: George S. Klaiber, Tonawanda, N.Y.; Anthony C. Ippolito, DeKalb; William R. Hoskinson, Geneva, both of Ill.

[73] Assignee: The Wurlitzer Company, DeKalb, Ill.

[21] Appl. No.: 917,307

[22] Filed: Jun. 20, 1978

[51] Int. Cl.[3] ..... G10H 1/06

[52] U.S. Cl. ..... 84/1.22; 84/1.01

[58] Field of Search ..... 84/1.01, 1.11, 1.12, 84/1.19, 1.21, 1.22

[56] References Cited

U.S. PATENT DOCUMENTS

| | | | |
|---|---|---|---|
| 2,533,821 | 12/1950 | Langer | 84/1.19 |
| 3,097,253 | 7/1963 | Peterson | 84/1.12 |
| 3,534,144 | 10/1970 | Ring | 84/1.22 |
| 3,539,698 | 11/1970 | Omura et al. | 84/1.22 |
| 3,636,231 | 1/1972 | Schrecongost et al. | 84/1.11 |
| 3,748,944 | 7/1973 | Schrecongost | 84/1.22 |
| 3,878,749 | 4/1975 | Woron | 84/1.01 |
| 3,916,322 | 10/1975 | Nelson | 328/14 |
| 4,002,095 | 1/1977 | Mantani | 84/1.01 |
| 4,012,981 | 3/1977 | Nagahama | 84/1.01 |

*Primary Examiner*—J. V. Truhe
*Assistant Examiner*—Forester W. Isen
*Attorney, Agent, or Firm*—Trexler, Wolters, Bushnell & Fosse, Ltd.

[57] ABSTRACT

A plurality of rectangular waves of selected duty cycles and fundamental frequencies are generated. Selected ones of these waveforms are then added at selected amplitude ratios. Such additions provide resultant waveforms of desired fundamental frequencies and having desired harmonic contents or spectra, for simulating the characteristic sounds of acoustical musical instruments.

10 Claims, 3 Drawing Figures

WAVEFORM SYNTHESIS FOR AN ELECTRONIC MUSICAL INSTRUMENT

BACKGROUND OF THE INVENTION

Figure 1:
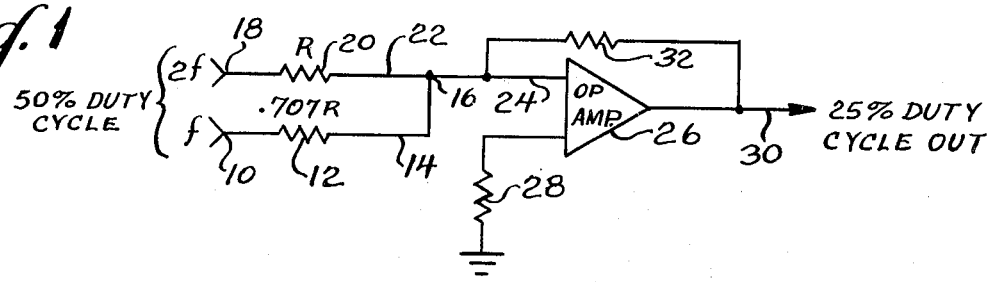

In accordance with the invention, a waveform having a harmonic structure closely approximating the sound of any given musical instrument may be readily produced by the expedient of selecting proper components to make up the waveform. Specifically, it has been found that conventional and easily produced square waves may be readily combined or otherwise manipulated to produce rectangular waves of selected frequencies and duty cycles. These rectangular waves may in turn be readily combined to produce a resultant waveform having virtually any desired harmonic structure. It can be confirmed by mathematical analysis that suitably selected and scaled rectangular waves of different duty cycles, when combined, result in waveforms having a harmonic content such that a highly accurate approximation of a given musical sound may be reproduced therefrom by conventional audio reproduction components.

The following detailed description is directed to one practical and preferred embodiment of the invention, wherein rectangular waves of selected duty cycle are produced by the combination of conventional square waves. These rectangular waves are then scaled in amplitude and combined to form a close approximation of a stair-step or sawtooth waveform, which may readily be filtered by conventional means to produce a resultant waveform having a desired harmonic content. It will be appreciated from the foregoing discussion, however, that the expedient of filtering is not strictly necessary, as the selection of rectangular waves of suitable duty cycles may be accomplished so as to form a resultant output waveform of desired harmonic structure, without filtering. However, it is believed preferable, as well as somewhat simpler, to initially produce a stair-step or sawtooth waveform, which is known to contain a full harmonic structure, and then to utilize conventional filters to remove or attenuate undesired harmonics, thus producing the desired harmonic structure in the resultant waveform. As will be seen in the following description, the number and identity of components utilized to accomplish the objects of the invention, in the preferred embodiment, are surprisingly simple, and yet considerably more accurate than any prior art structure or method of which we are aware, in producing the desired end results.

Electronic organs commonly are provided with the 12 semi-tones of the top octave of the organ. This may be done by means of 12 separate generators, or by means of a high frequency generator and 12 dividers of different divider ratio. These frequencies are applied to divide-by-two circuits to provide the remaining octaves of corresponding notes of the organ. Such division generally results in the production of square waves, i.e. rectangular waves of 50% duty cycle. Such waves are readily filtered to produce the flute tones, which are essentially sine waves with little or no harmonic structure. Such waves also produce remarkably good clarinet tones, but present problems with other tones, since square waves inherently present only an odd harmonic series, the even harmonics being lacking. It has been common practice to distort the square waves in keying, or to combine a plurality of square waves of multiple frequencies to approximate a staircase. The staircase, in turn, approximates a sawtooth wave which has (ideally) all of the harmonics present, whereby the wave may be filtered to produce substantially any desired type of instrumental tone. Unfortunately, such staircase waves are imperfect approximations, to the extent that some harmonics are missing or are of too low an amplitude to produce the desired sounds, when filtered.

OBJECTS AND SUMMARY OF THE DISCLOSURE

In accordance with the present invention it is an object thereof to utilize common square waves to produce rectangular waves of selected duty cycles which have appropriate harmonic content, for accurately simulating the sounds of acoustic musical instruments when combined at selected relative amplitudes.

In one practical and preferred embodiment, rectangular waves of 50% duty cycle (i.e., square waves) and respectively of frequencies f, and 2 f are combined at a fixed amplitude ratio to produce a remarkably accurate rectangular wave of 25% duty cycle, having a much better harmonic content than a rectangular wave at 50% duty cycle. Further combination of a rectangular wave of 25% duty cycle and frequency f, derived as aforesaid, with a similarly derived rectangular wave of 25% duty cycle and of frequency 2 f results in the production of a remarkably good approximation to a staircase wave spectrum.

THE DRAWINGS

Figure 2:
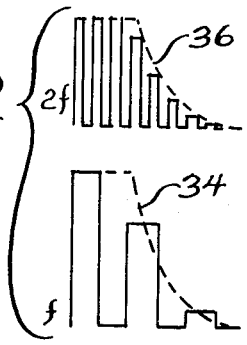
Figure 3:
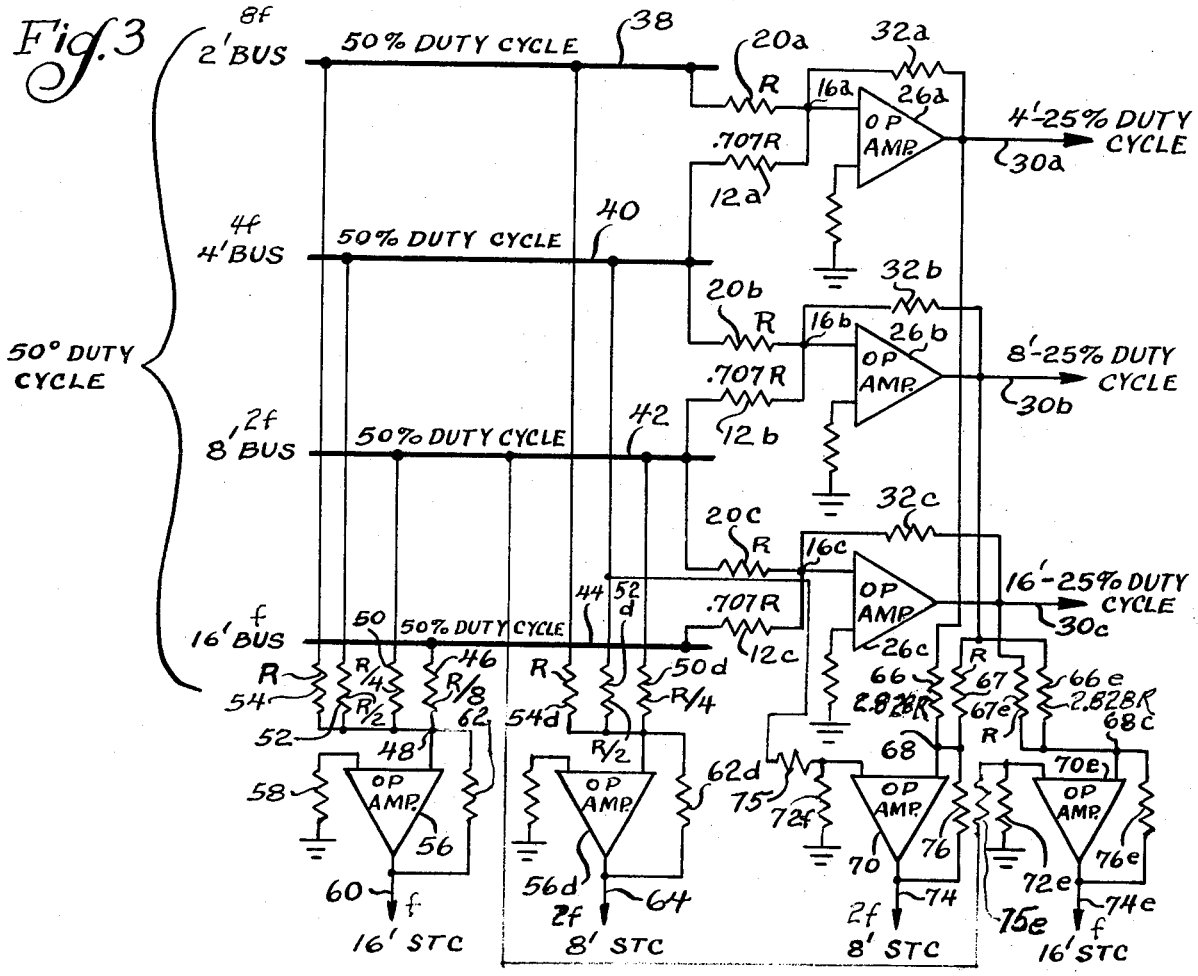

The present invention will best be understood with reference to the ensuing description of a preferred embodiment when taken in connection with the accompanying drawings wherein:

FIG. 1 comprises a wiring diagram showing the addition of the 2–50% duty cycle waves to simulate a 25% duty cycle rectangular wave;

FIG. 2 comprises a wave diagram illustrating the enveloping of the requisite waves before addition; and FIG. 3 comprises a wiring diagram of a portion of an organ showing the principles of FIG. 1 applied thereto.

DETAILED DISCLOSURE

Turning now to FIG. 1, a frequency f is connected at 10 to the input side of a resistor 12 having a relative resistance of about 0.707 R. The right or output side of the resistor is connected through a line 14 to a junction 16. In the same manner a frequency 2 f is connected at 18 to the left or input side of a resistor 20 having a relative resistance of R. This resistor is connected through a line 22 to the junction 16. From the junction 16 a connection 24 leads to one input of operational amplifier (OR AMP) 26. The other input of the OP AMP 26 is grounded through a resistor 28. The output of the OP AMP 26 appears at 30, and is connected back to the input lead 24 through a feedback resistor 32.

The foregoing circuit results in an additive combination of the two frequencies f and 2f. Each of these input frequencies comprises a rectangular wave of 50% duty cycle. It is preferred that the frequency f have a relative amplitude of A, while the frequency 2f (as combined) have a relative amplitude of 0.707A. For this reason, the two frequencies are of equal amplitude to start with, but are converted to the aforesaid relative amplitudes by the suitably chosen relative values of resistors 12 and 20.

The absolute amplitudes of the waves as combined is not important. The important fact is that the waves have relative amplitudes of A for frequency f, and a 0.707A for frequency 2f. Accordingly, the amplitudes need not be constant, and readily can be enveloped as illustrated in FIG. 2. Thus, the frequency F is subject to an envelope 34 of relative amplitude A, while the frequency 2f is subjected to an envelope 36 of relative amplitude 0.707A. It will be apparent from critical inspection of FIG. 2 that some approximation has been made of the actual enveloping, since the frequencies f and 2f have been rather considerably amplified on a horizontal scale in order to allow the individual cycles thereof to be seen.

Considerable variation of the 0.707A relative amplitude can be tolerated, depending on the tone coloration desired, which will differ with variation from the above number. Depending on the tone characteristics desired, variation of 20 percent or more in the relative amplitude can be tolerated and still give satisfactory results in accordance with the invention.

The output at 30 comprises a rectangular wave of frequency f and having the frequency spectrum of a 25% duty cycle rectangular wave. This may readily be seen without resorting to extensive mathematical analysis from the fact that the frequency f (a 50% duty cycle square wave) has a series of odd harmonics, appearing generally as follows:

f 3f 5f 7f

Similarly, the frequency 2f (also a sqaure wave) has odd harmonics which may be listed as follows:

2f 6f 10f

When these two frequencies f and 2f are added together, the summation may be seen as follows:

f—(f 3f 5f 7f)

2f—(2f 6f)

From this it will be seen that there are frequencies f, 2f, 3f, 5f, 6f, and 7f. The fourth and eighth harmonics are missing.

This is as it should be, as the spectrum of a 25% duty cycle rectangular wave is as follows:

f: 1
2f: 0.707
3f: 0.333
4f: 0
5f: 0.200
6f: 0.235
7f: 0.143
8f: 0

From the above it will be seen that the frequency f and the second harmonic thereof, namely 2f are at the ratios of 1 and 0.707 as previously noted. It is apparent that the fourth and eighth harmonics are missing from the 25% duty cycle wave, just as they are missing from the derived wave discussed above.

Coupling in organs and electronic organs is well known. In coupling two or more notes having different footages or octave relations are played at the same time by depression of a single key. As shown in FIG. 3 there is a two foot bus 38 to which all of the rectangular waves of 50% duty cycle of two foot characteristics are applied. There is also a four foot bus 40, an eight foot bus 42, and a sixteen foot bus 44. A two to one frequency ratio applies as between any adjacent pair of busses. Thus, if a frequency f appears on the sixteen foot bus, then a frequency 2f appears on the eight foot bus, and so forth. In accordance with the present invention adjacent pairs of busses have the signals thereon added together by circuitry as previously explained with regard to FIG. 1.

Thus, for example the four foot bus and the two foot bus bear a relation of f and 2f relative to one another. Numerals similar to those used in FIG. 1 with the addition of the suffix a are used to avoid duplication of description. Thus, the four foot bus 40, having a 50% duty cycle rectangular wave thereon is applied through a resistor **12*a* of relative value 0.707R to the OP AMP 26*a*, while the two foot bus, also having a 50% duty cycle rectangular wave thereon, is applied through resistor 20*a* of relative value R to the OP AMP 26*a*. The output thereof at 30*a*** comprises a four foot, rectangular wave which has a frequency spectrum identical to that of a rectangular wave of 25% duty cycle.

From here on the wave generated by combinating two 50% duty cycle waves in the manner described above will be referred to as being interchangeable and the same as a rectangular 25% duty cycle wave, to avoid duplication of disclosure.

The four foot and eight foot busses are combined similarly in an OP AMP 26*b*, the suffix b being used to avoid duplication of disclosure. In this instance the output **30*b* carries an eight foot wave of 25% duty cycle. Similarly, the sixteen foot bus 44 and eight foot bus 42 are connected to an OP AMP 26*c* to produce an output at 30*c* which is a sixteen foot wave at 25% duty cycle. It will be understood that in the present invention whenever any given key is depressed, for example the key to produce a C note, this C is produced simultaneously on the four busses 38, 40, 42, and 44. Accordingly, the three outputs appear on the output connections 30*a*, 30*b*, and 30*c*, all as aforesaid. All of the two foot notes that are played are applied to the two foot bus 38**, and so forth. In this manner excellent 25% duty cycle rectangular waves are simulated.

It is known in the prior art that the busses can be innerconnected to add the outputs thereon to approximate a staircase wave. Thus, in FIG. 3 the sixteen foot bus is connected through a resistor 46 having a relative value R/8 to a junction 48. The eight foot bus is connected through a resistor 50 having a value R/4 to the junction 48, while the four foot bus 40 is connected through a resistor 52 of relative value R/2 to the junction 48, and the two foot bus 38 is connected through a resistor 54 having a relative value of R to the junction 48. These resistors connected to the junction 48 all are connected to the input of an OP AMP 56, the other input of which is connected to ground through a resistor 58. The OP AMP 56 has an output at 60 which approximates a sixteen foot staircase wave, the output being returned to the junction 48 through a resistor 62.

An eight foot approximate staircase wave is produced at 64 by combining the outputs of the eight foot bus, the four foot bus, and the two foot bus through a circuit similar to that just described, similar numerals being used with addition of the suffix d.

In accordance with the present invention waves with the frequency spectrum of a staircase wave are provided by combination of adjacent 25% duty cycle outputs. Thus, by way of specific example the output at **30*a* is connected through a resistor 66 of relative value 2.828 to a junction 68 leading to the input of an OP AMP 70**.

the output 30*b* of the eight foot wave of 25% duty cycle is connected through a resistor 67, of relative value R, to the junction 68, and hence to the OP AMP 70. A resistor, 75, from the four foot bus is connected to the other input of OP AMP 70 to produce the proper amplitude of four foot 50% duty cycle component. Resistor 72, connected to ground forms a voltage divider path for the four foot wave input. The output 74 is returned through a resistor 76 to the junction 68 and hence to the input. The output 74 comprises a wave with the frequency spectrum of an eight foot staircase wave.

Similarly, a sixteen foot staircase wave is simulated by adding the output 30*c*, namely the sixteen foot 25% duty cycle rectangular wave, and the output at 30*b* of the eight foot 25% duty cycle rectangular wave. To avoid duplication of description similar numerals again are used with the addition of the suffix e.

In each instance in which reference has been made to relative resistances, the relationship pertains only as to adjacent resistors. Thus, the resistance R at 20 is not necessarily the same R as appears at 54, or as appears at 67. The important thing is the relative magnitudes of the signals as added, and the resistors are chosen in relative values to produce the necessary voltage relationship.

In accordance with the foregoing we have disclosed circuits for providing an improved synthesized 25% duty cycle rectangular wave which has for many purposes a superior harmonic structure to the usual 50% duty cycle rectangular wave. A superior staircase wave also is produced by the circuits disclosed.

The circuits shown may be embodied either using separate op amps, integrated circuits and discrete resistors connected in the manner shown or a single integrated circuit incorporating all of the elements shown. Thus LM 324 operational amplifier integrated circuits, obtainable from National Semiconductor Corporation, Santa Clara, California may be employed when embodying the invention using a plurality of integrated circuits. Alternatively, a custom integrated circuit including the operational amplifier circuit elements of the above integrated circuits, resistive elements, and appropriate interconnections on a common silicon substrate, may be provided. Such an integrated circuit may be fabricated using process techniques well known in the semiconductor industry, desirably in bipolar form. Since such techniques do not form a part of this invention, they will not be described in further detail.

The specific examples as herein shown and described, illustrate a specific embodiment. Various alternative embodiments will no doubt occur to those skilled in the art, and will be understood as forming a part of the present invention insofar as they fall within the spirit and scope of the appended claims.

The invention is claimed as follows:

1. In an electronic musical instrument, a first bus having a nominal footage B and carrying first rectangular waves of 50% duty cycle, a second bus having a nominal footage of $\frac{1}{2}$B and carrying second rectangular waves of 50% duty cycle, output means, and means for combining said first and second waves as rectangular waves at relative amplitudes A and about 0.707A to said output means to produce an output wave with a harmonic spectrum of a 25% duty cycle rectangular wave of footage B.

2. In an electronic musical instrument as set forth in claim 1, the combination in which the first and second rectangular waves appear on said first and second busses at equal amplitudes, and further including means for producing said waves at relative amplitudes A and about 0.707A.

3. A combination as set forth in claim 1 and further including a third bus having a nominal footage of $\frac{1}{4}$B and carrying third rectangular waves of 50% duty cycle, further output means, means for combining said second and third waves at relative amplitudes A and about 0.707A to said further output means to produce an output wave with a harmonic spectrum of 25% duty cycle rectangular wave of footage $\frac{1}{2}$B.

4. A combination as set forth in claim 3 and including additional output means combining the two resultant rectangular output waves at amplitudes of A and 1/2.828 A respectively with a 50% duty cycle rectangular wave with footage $\frac{1}{2}$B to provide a wave with a harmonic spectrum of a staircase wave of footage B.

5. A combination as set forth in claim 3 and further including a fourth bus having a nominal footage B/8 and carrying fourth rectangular waves of 50% duty cycle, third output means combining the third and fourth waves at relative amplitudes of A and about 0.707A to produce a third resultant output wave of footage $\frac{1}{4}$B.

6. A combination as set forth in claim 5 and further including first and second further output means respectively connecting the resultant output waves of footages $\frac{1}{2}$B and $\frac{1}{4}$B at amplitude ratio of about 2.828:1, and a 50% duty cycle rectangular wave at footage B/4 to provide a wave with the harmonic spectrum of a staircase wave of footage B/2.

7. Apparatus for producing a waveform comprising means providing a first 50% duty cycle rectangular wave of frequency f and relative amplitude A, means for providing a second 50% duty cycle rectangular wave of frequency 2f and amplitude 0.707A, and means for adding said first and second waves to produce a resultant wave, said resultant wave having the harmonic spectrum of a 25% duty cycle rectangular wave of frequency f.

8. Apparatus as set forth in claim 7 wherein said first and second waves initially are of known amplitude, and further including means for producing said waves at relative amplitudes A and about 0.707A.

9. The method of synthesizing a waveform which comprises providing a first 50% duty cycle rectangular wave of frequency f and amplitude A, providing a second 50% duty cycle rectangular wave of frequency 2f and relative amplitude about 0.707A, and adding said first and second waves to produce a resultant output wave with the harmonic spectrum of a 25% duty cycle rectangular wave at frequency f.

10. The method as set forth in claim 9 wherein said first wave and said second wave initially are provided at equal amplitude, and subsequently modifying said waves to produce the first thereof at relative amplitude A and the second thereof at relative amplitude about 0.707A.

* * * * *